US011852351B2

(12) United States Patent
Swayne et al.

(10) Patent No.: US 11,852,351 B2
(45) Date of Patent: Dec. 26, 2023

(54) STEAM COOKING APPLIANCE

(71) Applicant: Electrolux Home Products, Inc., Charlotte, NC (US)

(72) Inventors: Steven Swayne, Nashville, TN (US); Brendan McGinnis, Russellville, KY (US); Timothy Turner, Springfield, TN (US); Ashish Ainapure, Hendersonville, TN (US); Cathy L. May, Springfield, TN (US); Andrew Worley, Springfield, TN (US)

(73) Assignee: Electrolux Home Products, Inc., Charlotte, NC (US)

( * ) Notice: Subject to any disclaimer, the term of this patent is extended or adjusted under 35 U.S.C. 154(b) by 206 days.

(21) Appl. No.: 17/193,071

(22) Filed: Mar. 5, 2021

(65) Prior Publication Data

US 2021/0190326 A1 Jun. 24, 2021

Related U.S. Application Data

(63) Continuation of application No. 15/603,361, filed on May 23, 2017, now Pat. No. 10,969,118.

(60) Provisional application No. 62/341,816, filed on May 26, 2016.

(51) Int. Cl.
*F24C 15/32* (2006.01)

(52) U.S. Cl.
CPC ..... *F24C 15/327* (2013.01)

(58) Field of Classification Search
CPC ..... F24C 15/325; F24C 15/327; F24C 7/006; A47J 27/04; A47J 2027/043
USPC ..... 219/400, 401
See application file for complete search history.

(56) References Cited

U.S. PATENT DOCUMENTS

| | | | |
|---|---|---|---|
| 4,700,685 | A | 10/1987 | Miller |
| 4,835,351 | A | 5/1989 | Smith |
| 5,394,791 | A | 3/1995 | Vallee |
| 5,525,782 | A | 6/1996 | Yoneno et al. |
| 5,601,013 | A | 2/1997 | Larsson et al. |

(Continued)

FOREIGN PATENT DOCUMENTS

| | | |
|---|---|---|
| EP | 0517681 | 12/1992 |
| GB | 2388424 | 11/2003 |

(Continued)

OTHER PUBLICATIONS

Title: Baking Oven. URL: http://www.kolb-hk.com/Download/Kolb_hk/EQ/Baking_Oven.pdf.

(Continued)

*Primary Examiner* — Dana Ross
*Assistant Examiner* — Joe E Mills, Jr.
(74) *Attorney, Agent, or Firm* — Pearne & Gordon LLP

(57) ABSTRACT

A cooking appliance includes a cooking chamber that defines an oven cavity and a reservoir for holding water that is accessible from within the oven cavity. The cooking appliance further includes a convection heating system, a reservoir heating system, and a control system. The convection heating system includes a convection heating element and a fan for guiding air across the convection heating element. The reservoir heating system includes at least one reservoir heating element. The control system is configured to control the convection heating system and the reservoir heating system to perform a steam cooking operation in response to a user steam-cooking input.

22 Claims, 5 Drawing Sheets

(56) References Cited

U.S. PATENT DOCUMENTS

| | | | |
|---|---|---|---|
| 5,735,190 | A | 4/1998 | Sham |
| 5,869,812 | A | 2/1999 | Creamer et al. |
| 5,951,901 | A | 9/1999 | Douglas et al. |
| 6,107,605 | A | 8/2000 | Creamer et al. |
| 6,175,100 | B1 | 1/2001 | Creamer et al. |
| 6,516,712 | B1 | 2/2003 | Ratermann et al. |
| 6,802,708 | B2 | 10/2004 | Kanzaki et al. |
| 6,833,534 | B2 | 12/2004 | Bellassai et al. |
| 6,927,364 | B2 | 8/2005 | Ko |
| 6,987,246 | B2 | 1/2006 | Hansen et al. |
| 6,992,268 | B2 | 1/2006 | Kim |
| 7,060,941 | B1 | 6/2006 | Embury et al. |
| 7,208,701 | B2 | 4/2007 | Fraccon et al. |
| 7,309,846 | B2 | 12/2007 | Haberkamm et al. |
| 7,326,891 | B2 | 2/2008 | Sung et al. |
| 7,777,158 | B2 | 8/2010 | Saltenis et al. |
| 8,190,302 | B2 | 5/2012 | Burt et al. |
| 8,389,907 | B2 | 3/2013 | Willett |
| 8,541,719 | B2 | 9/2013 | Steurer |
| 8,642,929 | B2 | 2/2014 | Saltenis et al. |
| 8,647,692 | B2 | 2/2014 | Giazzon et al. |
| 8,803,040 | B2 | 8/2014 | Steurer |
| 8,843,242 | B2 | 9/2014 | Burt |
| 9,119,231 | B2 | 8/2015 | Johnson et al. |
| 9,303,878 | B2 | 4/2016 | Burt et al. |
| 2004/0187700 | A1 | 9/2004 | Tippmann |
| 2006/0000821 | A1* | 1/2006 | Gerola ..... F24C 15/327 219/401 |
| 2006/0249136 | A1 | 11/2006 | Reay |
| 2006/0251785 | A1 | 11/2006 | Fraccon et al. |
| 2007/0062927 | A1 | 3/2007 | Sells |
| 2009/0194092 | A1 | 8/2009 | Shon et al. |
| 2009/0218332 | A1 | 9/2009 | Negandhi et al. |
| 2010/0092625 | A1 | 4/2010 | Finch et al. |
| 2012/0055459 | A1 | 3/2012 | Ley, III |
| 2012/0145696 | A1 | 6/2012 | Johnson |
| 2012/0294992 | A1 | 11/2012 | Sager |
| 2014/0205727 | A1 | 7/2014 | Distaso et al. |
| 2014/0311360 | A1 | 10/2014 | Bartelick et al. |
| 2015/0014865 | A1 | 1/2015 | Frueh et al. |
| 2015/0173551 | A1 | 6/2015 | Carbone et al. |

FOREIGN PATENT DOCUMENTS

| | | |
|---|---|---|
| JP | 2000093322 | 4/2000 |
| JP | 2002327922 | 11/2002 |
| WO | 2007065315 | 6/2007 |
| WO | 2009065197 | 5/2009 |
| WO | 2009097960 | 8/2009 |

OTHER PUBLICATIONS

Title: Convection steam ovens promise speedy cooking. URL: http://www.consumerreports.org/cro/news/2014/01/convection-steam-ovens-from-wolf-and-thermador-promise-speedy-cooking/index.htm.

* cited by examiner

STEAM COOKING APPLIANCE

CROSS-REFERENCE TO RELATED APPLICATIONS

This application is a continuation of U.S. application Ser. No. 15/603,361 filed on May 23, 2017 which claims the benefit of U.S. Provisional Application No. 62/341,816, filed May 26, 2016, These applications are incorporated herein by reference.

FIELD

The present invention relates generally to methods and apparatus for controlling a cooking appliance, and, more particularly, for generating steam and for regulating a temperature of air within an oven cavity of the cooking appliance during a steam cooking operation.

BACKGROUND

Cooking appliances can include structure for cooking items within an oven cavity via convection. Moreover, some cooking appliances can include structure for baking items within the oven cavity. Furthermore, some cooking appliances include structure for steam-cooking items within the oven cavity. It is desirable to have structure and methodology for controlling a cooking appliance during steam cooking, convection cooking, and/or baking operations in an efficient and effective manner.

SUMMARY

In accordance with a first aspect, a cooking appliance includes a cooking chamber that defines an oven cavity and a reservoir for holding water that is accessible from within the oven cavity. The cooking appliance further includes a convection heating system, a reservoir heating system, and a control system. The convection heating system includes a convection heating element and a fan for guiding air across the convection heating element. The reservoir heating system includes at least one reservoir heating element. The control system is configured to control the convection heating system and the reservoir heating system to perform a steam cooking operation in response to a user steam-cooking input.

In accordance with a second aspect, a cooking appliance includes a cooking chamber that defines an oven cavity and a reservoir for holding water. The cooking appliance further includes a convection heating system, a reservoir heating system, and a shroud. The convection heating system includes a convection heating element and a fan for guiding air across the convection heating element. The reservoir heating system is configured to heat water in the reservoir in order to generate steam. The shroud at least partially covers the reservoir and includes an opening and a door for providing selective access to the reservoir through the opening.

In accordance with a third aspect, a method of operating a cooking appliance includes a step of performing a steam cooking operation. The steam cooking operation includes operating a convection heating system to regulate the temperature of air within an oven cavity of the appliance. The steam cooking operation further includes operating a reservoir heating system to heat a reservoir accessible from within the oven cavity and generate steam.

BRIEF DESCRIPTION OF THE DRAWINGS

The foregoing and other aspects will become apparent to those skilled in the art to which the present examples relate upon reading the following description with reference to the accompanying drawings, in which.

DETAILED DESCRIPTION

Figure 1:
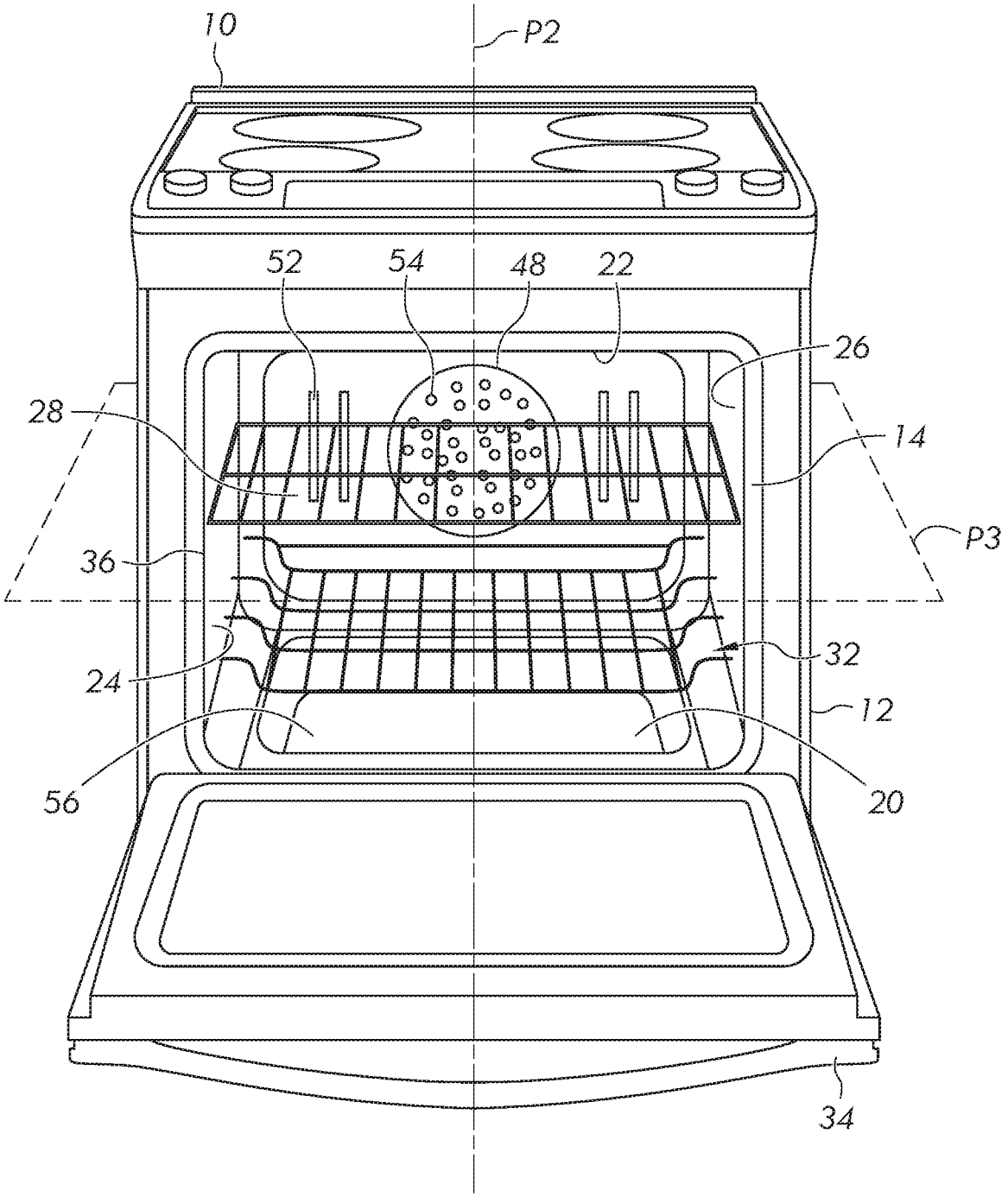
FIG. 1 is a schematic front perspective view of an example cooking appliance.

Certain terminology is used herein for convenience only and is not to be taken as a limitation. In the drawings, certain features may be shown in somewhat schematic form.

It is to be noted that the term "energized" as used herein when describing a heating system or, more specifically, a heating element of the heating system, refers to a state in which chemical or electrical energy (e.g., combustible fuel, current, etc.) is being supplied to the heating element where that energy is used to generate (i.e. is converted to) thermal energy for heat transfer. For example, an electric-resistance heating element of a heating system is energized when current is being passed through that heating element to generate heat. The term "energized" does not refer to a state in which the heating element may be dissipating or radiating heat but is not being supplied with energy. For example, the resistance heating element described above would not be in an energized state when no electrical current is flowing to the element, even though the element may continue to dissipate or radiate residual heat while there is no current.

Figure 2:
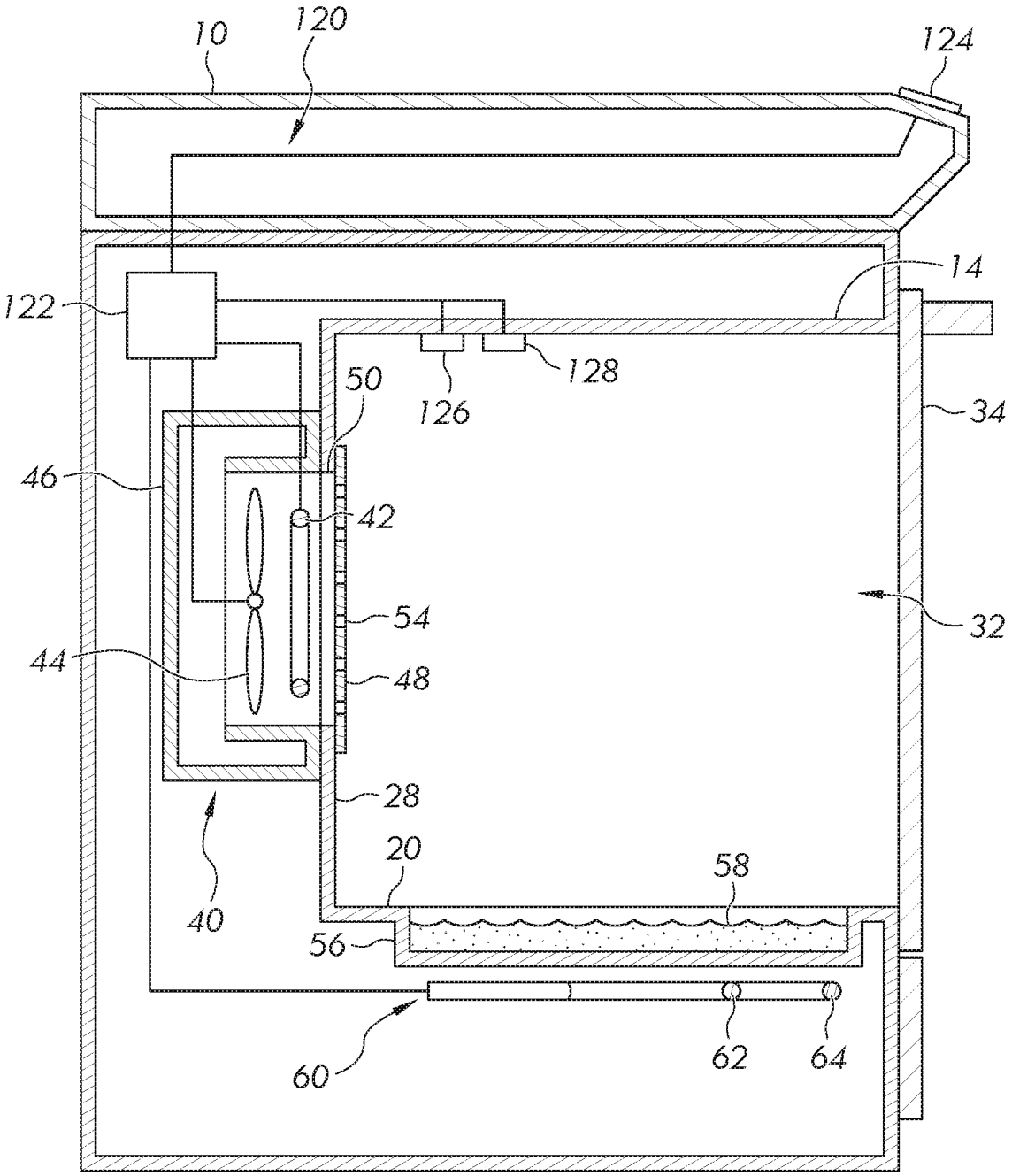
FIG. 2 is a schematic cross-sectional view of the example cooking appliance taken along plane P2 in FIG. 1, with the door in a closed position.
Figure 3:
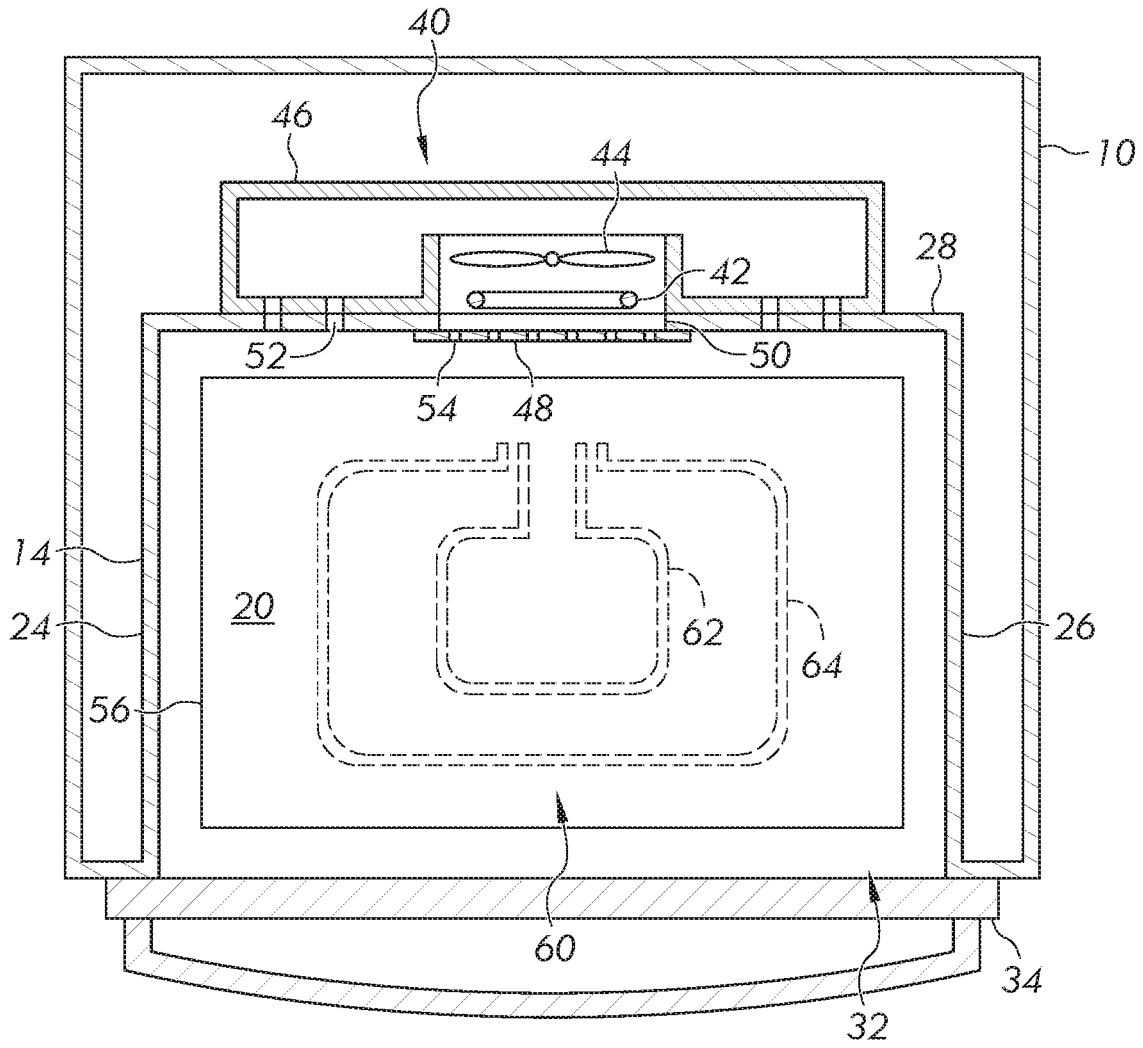
FIG. 3 is a schematic cross-sectional view of the example cooking appliance taken along plane P3 in FIG. 1, with the door in the closed position.

An example cooking appliance 10 is shown in FIGS. 1-3. The appliance 10 includes a housing 12 that supports a cooking chamber 14. The cooking chamber 14 has a bottom wall 20, a top wall 22, a pair of opposing side walls 24, 26, and a rear wall 28 that collectively define an oven cavity 32. The cooking appliance 10 further includes a door 34 that can provide selective access to the oven cavity 32 through an opening 36 defined at the front of the cooking chamber 14.

The cooking appliance 10 includes a convection heating system 40 for heating air within the oven cavity 32 via convection. As discussed further below, the convection heating system 40 can be controlled to perform a steam cooking operation or a convection cooking operation. The convection heating system 40 can include one or more convection heating elements and one or more fans associated with the convection heating element(s) for guiding air across the convection heating element(s). For instance, in the present example the convection heating system 40 includes one convection heating element 42 and one fan 44 associated with the convection heating element 42 for guiding air across the convection heating element 42. However, in other examples, the convection heating system 40 may have one convection heating element 42 associated with multiple fans 44, multiple convection heating elements 42 associated with the same fan 44, and/or multiple convection heating elements 42 that are each associated with one or more different fans 44. The convection heating element 42 can be an electric-resistance element (e.g., coil) that generates heat via an electric current. Alternatively, the convection heating element 42 can be some other element (e.g., an induction coil or gas burner assembly) that can be energized to produce heat for transfer to the oven cavity air via convection. The fan 44 may be located downstream from the convection heating element 42 to pull (i.e., suck) air past the convection heating element 42, or the fan 44 may be located upstream from the convection heating element 42 to push (i.e., blow) air past the convection heating element 42.

The convection heating system 40 may be located within the oven cavity 32 or it may be located outside of the cooking chamber 14 and fluidly coupled with the oven cavity 32 via one or more air passageways. In some examples, the cooking chamber 14 may form part of the convection heating system 40. In the present example, the convection heating system 40 has a housing 46 attached to the rear wall 28 of the cooking chamber 14. The housing 46 houses the convection heating element 42 and fan 44. The convection heating system 40 further includes a cover 48 that is attached to the rear wall 28 and covers an opening 50 in the rear wall 28. As the fan 44 is operated, air is drawn from the oven cavity 32 into the housing 46 via one or more inlets 52 in the rear wall 28. The air is then guided past the convection heating element 42 and blown through one or more outlets 54 in the cover 48 back into the oven cavity 32. However, the convection heating system 40 may have a variety of configurations for guiding air past the convection heating element 42.

The cooking appliance 10 further includes a reservoir 56 for holding water 58 that can be heated to generate steam for dispersal throughout the oven cavity 32. The reservoir 56 is accessible from within the oven cavity 32 and is preferably sized to hold a maximum of about 12 cups of water, though other volumes are possible. In some examples, the reservoir 56 is disposed at a base of the cooking chamber 14 and, in particular, at least partially forms the base of the cooking chamber 14. For instance, in the illustrated embodiment the reservoir 56 is formed at the base of the cooking chamber 14 as a recessed embossment in the bottom wall 20 of the cooking chamber 14. In particular, the reservoir 56 comprises a sump of the cooking chamber 14. However, the reservoir 56 may be disposed at other locations and/or may form other portions of the cooking chamber 14. Moreover, the reservoir 56 may be a separate structure (e.g., a pan or a vessel) that is provided within the cooking chamber 14.

For instance, in some examples the reservoir 56 may be a pan that rests on a rack within the cooking chamber 14. Alternatively, the pan may hang from an underside of the rack using for example, one or more brackets, such that the pan is suspended above the bottom wall 20 of the cooking chamber 14. In such examples, the rack can be a wire rack and the pan can be located relatively close to the rack such that steam from the pan will disperse through openings formed by the wire(s) of the rack and contact any food items or cooking vessels resting on top of the rack. The reservoir 56 may be any structure that holds water for heating to generate steam.

The cooking appliance 10 further includes a reservoir heating system 60 configured to heat the reservoir 56 that, as discussed further below, can be controlled to perform a steam cooking operation or a baking operation. The reservoir heating system 60 can include one or more heating elements such as, for example, a first heating element 62 and a second heating element 64, that are located exterior of the oven cavity 32 and reservoir 56 below the bottom wall 20 of the cooking chamber 14. However, the reservoir heating system 60 may include any number of heating elements in other examples. Moreover, one or more heating elements may be provided in other locations such as, for example, within the actual reservoir 56 or within some other portion of the oven cavity 32. Furthermore, one or more heating elements may form a portion of the reservoir 56 itself. Each heating element can be an electric-resistance element (e.g., coil) that generates heat via an electric current, or some other element (e.g., an induction coil or gas burner assembly) that can be energized to produce heat for transfer to the water 58 within the reservoir 56 or other portions of the cooking chamber 14 (e.g., the air within the oven cavity 32).

When the reservoir heating system 60 includes more than one heating element, the reservoir heating system 60 can be configured to provide different amounts of power for each heating element. For example, in the present embodiment the first and second heating elements 62, 64 are heating coils that are concentrically arranged such that the first heating element 62 is surrounded by the second heating element 64, as shown in FIG. 3. The reservoir heating system 60 can be configured to provide a first amount of power to the first heating element 62 when the first heating element 62 is energized and a second amount of power to the second heating element 64 when the second heating element 64 is energized. The second amount of power to the second heating element 64 may be greater than the first amount of power to the first heating element 62, or vice versa. Alternatively, the amounts of power for the heating element 62, 64 may be substantially similar or equal.

In some examples, the reservoir 56 may be an open reservoir provided at a base of the cooking chamber 14 such that the reservoir 56 is open to the oven cavity 32 and the surface of the water 58 in the reservoir 56 is exposed to the oven cavity 32. Moreover, the cooking appliance 10 can include a shroud 66 (shown in FIG. 4) that can be arranged within the oven cavity 32 to at least partially cover the reservoir 56 and the exposed surface of the water 58. The shroud 66 includes a panel 68 that will act as a barrier between the reservoir 56 and the oven cavity 32 to prevent food particles from falling into the reservoir 56. In the present example, the panel 68 can be suspended above the reservoir 56 on rails provided along the walls of the cooking chamber 14. In other examples though, the panel 68 can be suspended above the reservoir 56 using, for example, legs that sits on a floor of the reservoir 56 and hold the panel 68 above the surface of the water 58. A variety of different structure may be used to suspend the panel 68 above the reservoir 56.

In some examples, the shroud 66 includes a plurality of apertures 72 in the panel 68 for distributing steam about the oven cavity 32. As the water 58 in the reservoir 56 is heated and vaporized to steam, the steam will rise through the plurality of apertures 72 and permeate the oven cavity 32 above the panel 68. Some steam also may rise around one or more edges of the panel 68.

Figure 4:
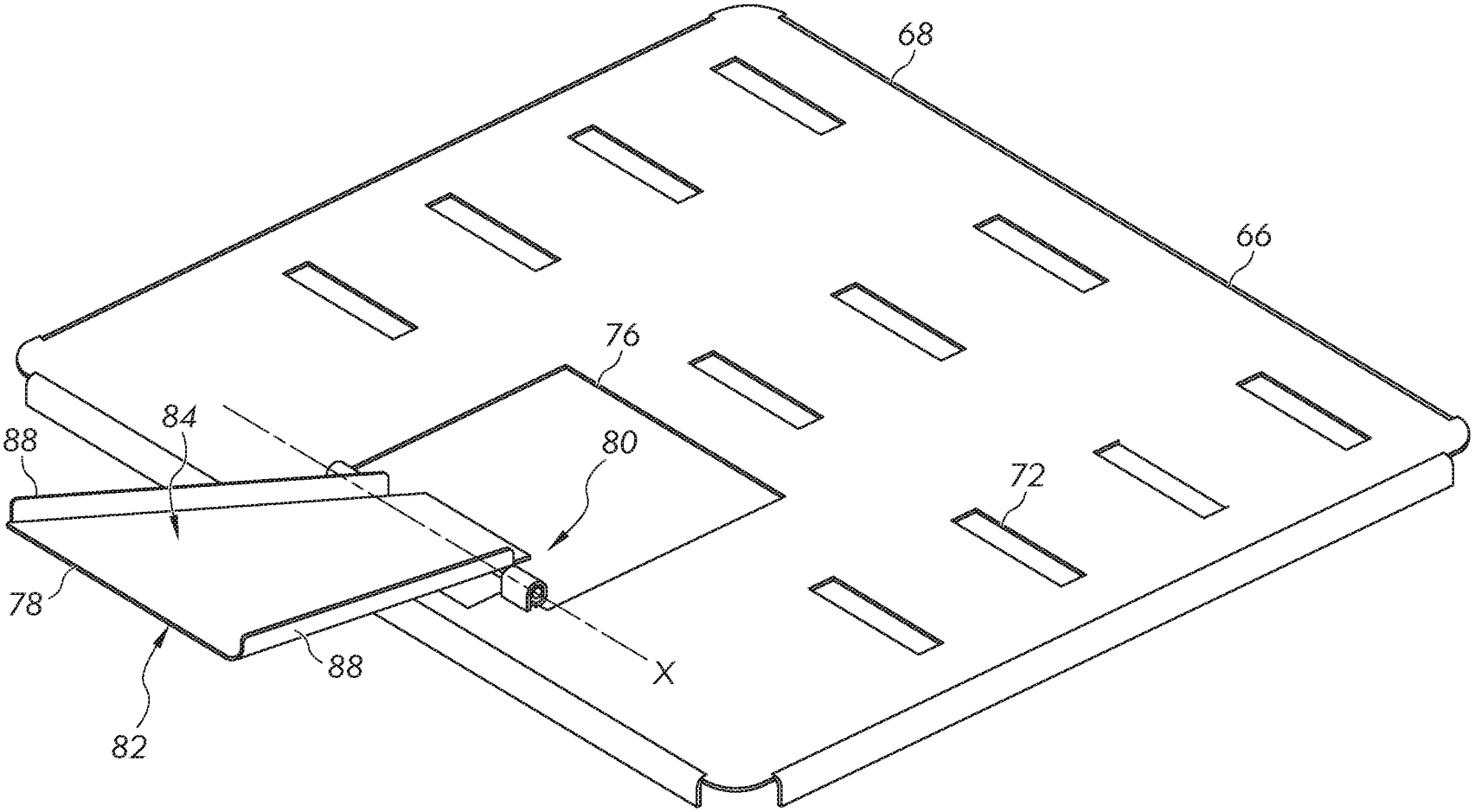
FIG. 4 is a perspective view of a shroud to be provided within an oven cavity of the example cooking appliance.

In some embodiments, the shroud 66 has an opening 76 in the panel 68. The opening 76 is preferably sized and located such that water can be poured through the opening 76 into the reservoir 56. In such embodiments, the shroud 66 can have a door 78 that is movably coupled to the panel 68 for providing selective access to the reservoir 56 through the opening 76. For example, the door 78 may be slidably coupled to the panel 68 or the door 78 may be pivotally coupled to the panel 68 with a hinge. In the present example, the door 78 is coupled to the panel 68 with a hinge assembly 80 that permits the door 78 to rotate between open and closed positions about a horizontal axis X that extends substantially parallel to the rear wall 28. The door 78 has first and second major surfaces 82, 84 that face opposite directions. In the closed position, the door 78 will cover the opening 76 and be arranged such that the first and second major surfaces 82, 84 are substantially horizontal with the first major surface 82 facing upward and the second major surface 84 facing downward toward the reservoir 56. From the closed position, the door 78 can be rotated about the horizontal axis X in a direction away from the rear wall 28 until the door 78 reaches its open position, as shown in FIG. 4. In the open position, the door 78 will be inclined such that the second major surface 84 faces upward and has a downslope toward the opening 76 and rear wall 28. With this arrangement, a consumer can fill the reservoir 56 from the front of the cooking appliance 10 by pouring water onto the second major surface 84, which will guide water downward through the opening 76 into the reservoir 56. In some examples, the door 78 can have a pair of guide walls 88 that extend from the second major surface 84 to help guide the water as it flows down the second major surface 84.

Figure 5:
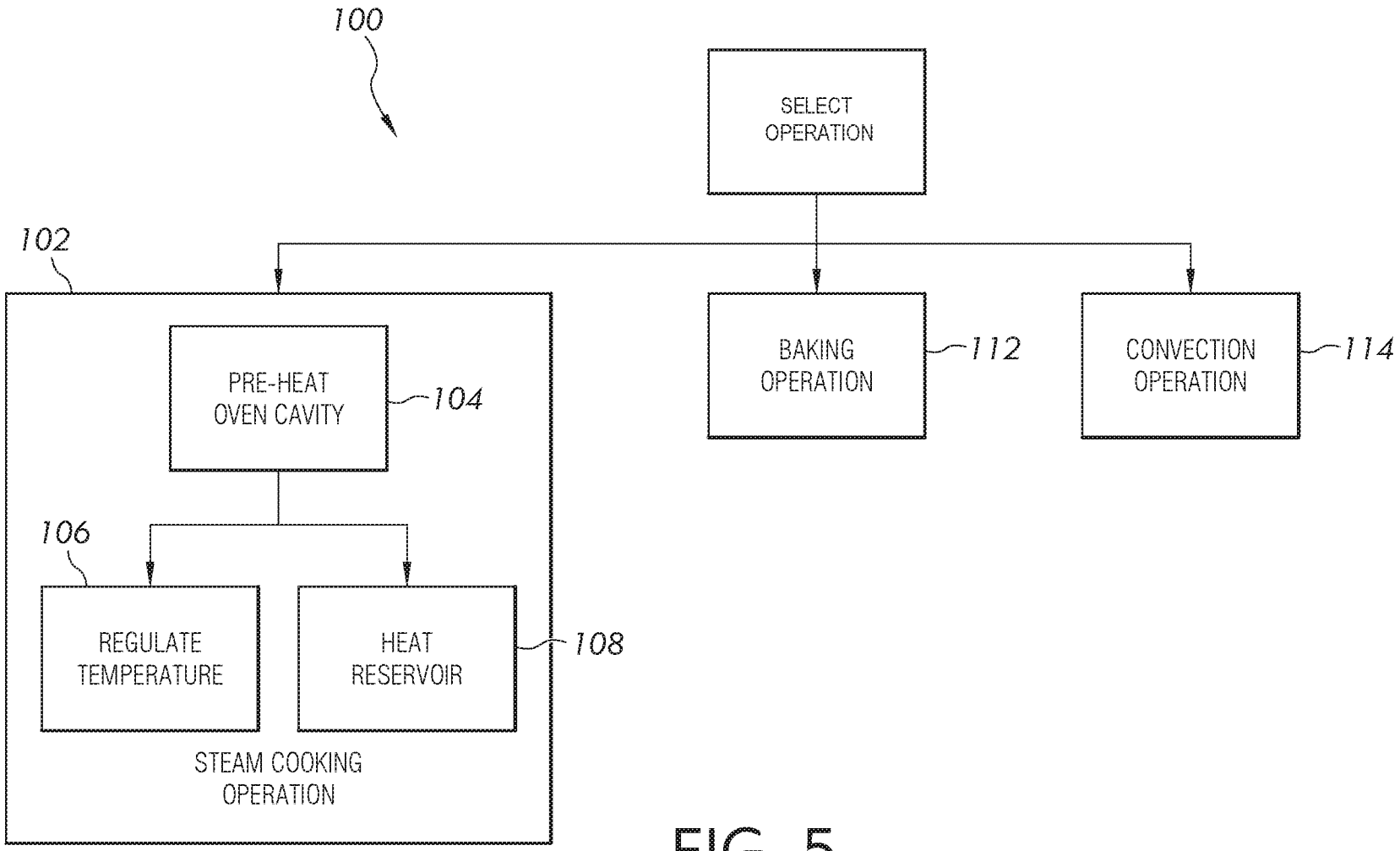
FIG. 5 is a flow chart illustrating a method of operating the example cooking appliance.

Turning now to FIG. 5, an example method 100 of operating the cooking appliance 10 will now be described. The method 100 includes a step of performing a steam cooking operation 102, which can include one or more sub-steps such as a pre-heating step 104, a temperature regulating step 106, and a reservoir heating step 108. The pre-heating step 104 comprises increasing the temperature of the air within the oven cavity 32 from a first temperature (e.g., room temperature) to a second temperature (e.g., a predetermined cooking temperature). The temperature regulating step 106 comprises regulating (e.g., adjusting and/or maintaining) the temperature of the air within the oven cavity 32. For instance, the temperature regulating step 106 can include maintaining the second temperature achieved during the pre-heating step 104 for a definite or indefinite period of time. In addition or alternatively, the temperature regulating step 106 can include adjusting (e.g., increasing or decreasing) the temperature of the air within the oven cavity 32 from the second temperature to a third temperature that is different from (e.g., greater than or less than) the second temperature. The reservoir heating step 108 comprises heating the reservoir 56 to a temperature equal to or greater than the boiling point of water such that water (if present in the reservoir 56) is converted to steam. The steam cooking operation 102 can comprise any one or more of the pre-heating step 104, temperature regulating step 106, and reservoir heating step 108.

The temperature regulating step 106 is preferably initiated after completion of the pre-heating step 104. The reservoir heating step 108 can be initiated before, during, or after either of the pre-heating step 104 and the temperature regulating step 106. Water can be added to the reservoir 56 either before or during the reservoir heating step 108. In a preferred embodiment, water will be added to the reservoir 56 prior to the steam cooking operation 102 when the oven cavity 32 is at room temperature. The pre-heating step 104 will then be performed, followed by the temperature regulating step 106 upon completion of the pre-heating step 104. The reservoir heating step 108 preferably will likewise be initiated after the pre-heating step 104, thereby mitigating the amount of steam generated in oven cavity 32 during the pre-heating step 104. By mitigating the amount of steam generated during the pre-heating step 104, the potential for scalding to occur when a user opens the door 34 immediately after conclusion of the pre-heating step 104 can be reduced.

The pre-heating step 104, temperature regulating step 106, and reservoir heating step 108 can be performed by operating the convection system 40 and/or the reservoir heating system 60. The convection heating system 40 typically provides more accurate control of air temperature than the reservoir heating system 60. Accordingly, in a preferred embodiment, the pre-heating step 104 and temperature regulating step 106 will each be performed by operating the convection heating system 40 independently of the reservoir heating system 60 such that the convection heating system 40 will provide substantially 100% of the active control (relative to the reservoir heating system 60) for regulating (e.g., adjusting or maintaining) air temperature during the pre-heating step 104 and temperature regulating step 106. In other words, the reservoir heating system 60 will not be operated (e.g., actively controlled) for the purposes of regulating air temperature, i.e. it will not be operated based on or in response to any measurement or sensing of the air temperature within the oven cavity 32 during the pre-heating step 104 and the temperature regulating step 106. Rather, the air temperature within the oven cavity 32 will be regulated by operating one or more aspects of the convection heating system 40. For example, during the pre-heating step 104 and temperature regulating step 106, the air temperature within the oven cavity 32 can be regulated by energizing the convection heating element 42, de-energizing the convection heating element 42, maintaining the convection heating element 42 in an energized or de-energized state, turning on the fan 44, turning off the fan 44, maintaining the fan 44 in an on or off state, or some combination thereof.

The reservoir heating system 60 typically is more efficient at heating the reservoir 56 than the convection heating system 40. Accordingly, in the preferred embodiment, the reservoir heating step 108 will be performed by operating the reservoir heating system 60 to heat the reservoir 56. If the reservoir heating system 60 has multiple heating elements, the reservoir heating step 108 can include energizing one or more of the heating elements. For example, the reservoir heating step 108 can include energizing only the first heating element 62, only the second heating element 64, or both the first and second heating elements 62, 64, Preferably, only one of the heating elements 62, 64 will be energized in order to conserve energy and prevent rapid water loss in the reservoir 56. In particular, the heating element that receives the lower amount of power (of the two elements) will be energized while the heating element that receives the higher amount of power will not be energized. However, any number of heating elements can be energized in the reservoir heating step 108.

As discussed above, the pre-heating step 104 and temperature regulating step 106 are preferably performed by operating the convection heating system 40 independently of the reservoir heating system 60 such that the convection heating system 40 provides substantially 100% of the active control of the air temperature in the oven cavity 32 during the pre-heating step 104 and the temperature regulating step 106. Meanwhile, the reservoir heating step 108 is preferably performed by operating the reservoir heating system 60 to heat the reservoir 56, solely for the purpose of generating steam. However, if the reservoir heating system 60 is operated during the pre-heating step 104 and/or temperature regulating step 106, the reservoir heating system 60 may have some influence on the air temperature within the oven cavity 52 while it heats the reservoir 56. To the extent that this is the case, however, it is still only the convection heating system 60 that will be actively operated to regulate the air temperature in the oven cavity 32 in response to temperature changes or fluctuations therein. More specifically, the duration and degree of energization of the reservoir heating system 60 will be determined based on one or more factors other than air temperature such as, e.g., a predetermined time interval, a detected steam level (% R.H.), sensing (or not) of a boil-dry condition in the reservoir 56, a user command, a temperature of the reservoir 56, a temperature of a heating element for the reservoir heating system 60, or some combination thereof. As such, the reservoir heating system 60 will not be actively operated to achieve or maintain a particular air temperature. Accordingly, while the reservoir heating system 60 may be operated in a manner that affects air temperature, the reservoir heating system 60 will not be operated (e.g., actively controlled) or relied upon for the purposes of regulating air temperature. The result is an efficient system where the convection heating system 40 is operated to regulate air temperature while the reservoir heating system 60 is operated to heat the reservoir 56 and generate steam during a steam cooking operation 102.

Although it is preferable to have the convection heating system 40 provide substantially 100% of the active control of the air temperature in the oven cavity 32 during the pre-heating step 104 and the temperature regulating step 106, the convection heating system 40 in some embodiments may not be powerful enough to maintain or achieve certain desired temperatures (e.g., 300° F. or higher). For instance, in embodiments wherein the convection heating system 40 comprises an electric heating element 42 in an otherwise gas oven (e.g., wherein the reservoir heating system 60 comprises a gas burner), industry regulations may require that the electric heating element 42 of the convection heating system 40 have a relatively low power to prevent accidental ignition of gas being supplied to the oven. Thus, in such embodiments the convection heating system 40 and the reservoir heating system 60 may both be operated to provide control of the air temperature in the oven cavity 32 during the pre-heating step 104 and/or the temperature regulating step 106.

It should be noted that in embodiments wherein the reservoir heating system 60 is operated to help control air temperature in the oven cavity 32, the presence of water 58 within the reservoir 56 could limit the ability of the reservoir heating system 60 to facilitate control of air temperatures above the boiling point of water. More specifically, if the reservoir 56 is located at the bottom of the oven cavity 32 between the oven cavity 32 and the heating element(s) 62, 64 of the reservoir heating system 60, water 58 within the reservoir 56 can act as an insulator that limits the ability of the reservoir heating system 60 to heat the air within the oven cavity 32 above the boiling point of water. In particular, since the maximum attainable temperature of water/steam is its boiling point (e.g., 212° F. at standard pressure), the highest temperature to which the reservoir heating system 60 would be able to heat the reservoir 56 (and the air above the reservoir 56) while the reservoir 56 contains water 58 is the water's boiling point. Thus, the reservoir heating system 60 would not be able to facilitate the maintenance or attainment of air temperatures in the oven cavity 32 above the boiling point of water. Indeed, even if the air within the oven cavity 32 were supplemented with heat from the convection heating system 40 in order to achieve a temperature above the boiling point of water, the reservoir 56 would act as a heat sink that tends to cool the air within the oven cavity 32 and can counteract the heating effect of the convection heating system 40. Accordingly, in embodiments wherein the reservoir heating system 60 is operated to help control air temperature in the oven cavity 32, it is preferable that 1) water is not present within the reservoir 56 while controlling air temperature with the reservoir heating system 60; and/or 2) water is provided so that it is not a barrier between the heating element(s) 62, 64 of the reservoir heating system 60 and the air within the oven cavity 32. For example, the water can be provided in a pan that rests on a rack within the oven cavity, or that is suspended beneath a rack on which food being cooked rests, as described above.

In some examples, the method 100 also includes the step 112 of performing a baking operation. In contrast to the steam cooking operation 102, the baking operation 112 can regulate the temperature of the air within the oven cavity 32 by operating the reservoir heating system 60 independently of the convection heating system 40. In other words, the convection heating system 40 is not necessarily solely relied upon (e.g., controlled) for the purposes of regulating air temperature during the baking operation 112. Rather, the reservoir heating system 60 can provide up to substantially 100% of the active control (relative to the convection heating system 40) for regulating air temperature. Indeed, in some examples the convection heating system 40 will not be operated (e.g., energized) to regulate air temperature or for any other purpose during the baking operation 112.

During the baking operation 112, one or more of the heating elements of the reservoir heating system 60 can be operated in order to adjust or maintain the oven air temperature. For example, the air temperature can be adjusted or maintained by energizing either or both of the first and second heating elements 62, 64, de-energizing either or both of the first and second heating elements 62, 64, maintaining either or both of the first and second heating elements 62, 64 in an energized or de-energized state, or some combination thereof. In some examples, one of the first and second heating elements 62, 64 can be operated (e.g., energized) to generate steam during the steam cooking operation 102, while the other of the heating elements 62, 64 is operated (e.g., energized) during the baking operation 102 to regulate the oven air temperature. In particular, the heating element that receives the higher amount of power can be operated during the baking operation 102 to regulate oven air temperature.

As noted above, the presence of water 58 within the reservoir 56 could limit the ability of the reservoir heating system 60 to facilitate control of air temperatures in the oven cavity 32 above the boiling point of water. Accordingly, during the baking operation 112, it is preferable that 1) water is not present within the reservoir 56; and/or 2) the water (if present to facilitate steam baking) is provided within the oven cavity 32 such that it is not a barrier between the heating element(s) 62, 64 of the reservoir heating system 60 and the air within the oven cavity 32. However, it is to be appreciated that the reservoir 56 may nonetheless contain some amount of water during the baking operation 112, particularly at the beginning of the baking operation 112 before it is boiled substantially dry.

In further examples, the method 100 also can include the step of performing a convection operation 114. Preferably, the convection operation 114 can regulate the temperature of the air within the oven cavity 32 by operating the convection heating system 40 without operating the reservoir heating system 60. In particular, the reservoir heating system 60 will not necessarily be energized during the convection operation 114. As such, the convection heating system 40 will provide up to substantially 100% of the active control and thermal energy (relative to the reservoir heating system 60) for regulating air temperature in the convection operation 114. However, in embodiments wherein the convection heating system 40 does not have sufficient power to provide 100% of control for regulating air temperature during the convection operation 114, the reservoir heating system 60 may be operated in combination with the convection heating system 40 to regulate air temperature during the convection operation 114.

The method 100 can include steps for performing the steam cooking operation 102, the baking operation 112, the convection operation 114, or any combination thereof. In some embodiments, the cooking appliance 10 can include a control system 120 (shown in FIG. 2) configured to automatically perform any of the method steps described above. The control system 120 includes a controller 122 that can be connected to the convection heating system 40 and/or the reservoir heating system 60. Moreover, the control system 120 can include a user interface 124 that is connected to the controller 122 and can permit a user to selectively provide command signals to the controller 122. Furthermore, the control system 120 can include one or more sensors connected to the controller 122 that can be used to detect various parameters of the cooking appliance 10 and send signals to the controller 122 that are indicative of the detected parameters. For example, the control system 120 can include a temperature sensor 126 that is configured to detect a temperature of the air within the oven cavity 32 or a steam sensor 128 that is configured to detect an amount of steam (e.g. % R.H.) within the oven cavity 32. The controller 122 can be any kind of microprocessor unit that is configured to receive one or more inputs (e.g., signals) and to control the convection heating system 40 and/or the reservoir heating system 60 based on the received input(s).

The control system 120 can be configured to control the convection heating system 40 and the reservoir heating system 60 to automatically perform the steam cooking operation 102 described above. For example, in response to a user input (e.g., a steam-cooking start command entered using the user interface 124), the controller 122 can perform the pre-heating step 104 and the temperature regulating step 106 by controlling one or more aspects of the convection heating system 40 in order to adjust and/or maintain the temperature of the air within the oven cavity 32. In particular, the controller 122 can adjust or maintain the temperature by energizing the convection heating element 42, de-energizing the convection heating element 42, maintaining the convection heating element 42 in an energized or de-energized state, turning on the fan 44, turning off the fan 44, maintaining the fan 44 in an on or off state, or some combination thereof. In embodiments wherein the convection heating system 40 does not have sufficient power to provide 100% of the control for regulating air temperature during the pre-heating step 104 and/or the temperature regulating step 106, the controller 122 can control the reservoir heating system 60 in combination with the convection heating system 40 to perform the pre-heating step 104 and/or the temperature regulating step 106. In particular, the controller 122 can adjust or maintain air temperature by energizing one or both the first and second heating elements 62, 64, de-energizing one or both the first and second heating elements 62, 64, or maintaining one or both the first and second heating elements 62, 64 in an energized or de-energized state.

During the steam cooking operation 102, the control system 120 also can perform the reservoir heating step 108 by automatically energizing the reservoir heating system 60 to heat the reservoir 56 and the water 58 to generate steam within the oven cavity 32. If the reservoir heating system 60 has multiple heating elements, the controller 122 can be configured to automatically energize one or more of the heating elements. For example, the controller 122 can energize only the first heating element 62, only the second heating element 64, or both the first and second heating elements 62, 64. Preferably, only one of the heating elements 62, 64 will be energized in order to conserve energy and prevent rapid water loss in the reservoir 56. In particular, the heating element that receives the lower amount of power will be energized while the heating element that receives the higher amount of power will not be energized. However, any number of heating elements can be energized by the controller 122.

During the steam cooking operation 102, the control system 120 can be configured to perform the pre-heating step 104 and the temperature regulating step 106 sequentially. Moreover, the control system 120 can be configured to initiate the reservoir heating step 108 before, during, or after the pre-heating step 104 and/or temperature regulating step 106. For instance, in response to receiving the steam cooking start signal, the controller 122 can automatically perform the pre-heating step 104 to adjust (e.g., raise) the temperature of the air within the oven cavity 32 from a first temperature (e.g., room temperature) to a second temperature (e.g., a predetermined cooking temperature) using the convection heating system 40. Preferably, this is performed while the reservoir heating system 60 is not energized. Following the pre-heating step 104, the temperature sensor 124 will send a preheat-complete signal to the controller 122 indicating that the air within the oven cavity 32 has reached the second temperature. In response to the preheat-complete signal, the controller 122 can be configured to perform the temperature regulating step 106 to maintain the oven air temperature at the second temperature for an indefinite or a predetermined amount of time or to immediately adjust the temperature to another level. Moreover, in response to the preheat-complete signal, the controller 122 can automatically perform the reservoir heating step 108 by energizing the reservoir heating system 60 in order to heat the reservoir 56 and the water 58 within. As such, the reservoir heating system 60 will not be energized until the pre-heating step 104 is complete, thereby mitigating the amount of steam generated in oven cavity 32 during preheat.

During the steam cooking operation 102, the controller 122 can be configured to regulate the temperature of the air within the oven cavity 32 by controlling the convection heating system 40 independently of the reservoir heating system 60 such that the convection heating system 40 will provide up to substantially 100% of the active control (relative to the reservoir heating system 60) for regulating air temperature. Preferably, the control system 120 will not control the reservoir heating system 60 during the steam cooking operation 102 to regulate (e.g., actively maintain or adjust) air temperature within the cooking cavity, even though the control system 120 may control the reservoir heating system 60 to heat the reservoir 56 in a manner that incidentally affects air temperature. To the extent of any such incidental effect, the control system 120 will control the convection heating system 40 to compensate.

In some examples, the control system 120 also can be configured to control the reservoir heating system 60 to automatically perform the separate baking operation 112 described above. For example, in response to a user input (e.g., a baking start command entered using the user interface 124), the controller 122 can be configured to automatically regulate the temperature of the air within the oven cavity 32 by controlling the reservoir heating system 60 independently of the convection heating system 40 such that the control system 120 does not control the convection heating system 40 to regulate the temperature of the air. As such, the reservoir heating system 60 will provide up to substantially 100% of the active control (relative to the convection heating system 40) for regulating air temperature during such a baking operation 112. Indeed, in some examples the controller 122 will not control (e.g., energize) the convection heating system 40 for any purpose during the baking operation 112.

During the baking operation 112, the controller 122 can be configured to control one or more of the heating elements 62, 64 of the reservoir heating system 60 in order to adjust or maintain the oven air temperature. For example, the controller 122 can adjust or maintain the air temperature by energizing either or both of the first and second heating elements 62, 64, de-energizing either or both of the first and second heating elements 62, 64, maintaining either both of the first and second heating elements 62, 64 in an energized or de-energized state, or some combination thereof. In some examples, the controller 122 can be configured to energize only one of the first and second heating elements 62, 64 during the steam cooking operation 102, while controlling the other the first and second heating elements 62, 64 during the baking operation 112 to regulate the oven air temperature. In particular, the heating element that receives the higher amount of power can be energized in the baking operation 112 to regulate oven air temperature.

In further examples, the control system 120 also can be configured to control the convection heating system 40 to automatically perform the convection operation 114 described above. For example, in response to a user input (e.g., a convection-cooking start command entered using the user interface 124), the controller 122 can be configured to automatically regulate the temperature of the air within the oven cavity 32 by preferably controlling the convection heating system 40 without controlling the reservoir heating system 60. The reservoir heating system 60 need not be energized during the convection operation. As such, the convection heating system 40 will provide up to substantially 100% of the active control (relative to the reservoir heating system 60) for regulating air temperature in the convection operation 114. However, in embodiments wherein the convection heating system 40 does not have sufficient power to provide 100% of control for regulating air temperature during the convection operation 114, the controller 122 can control the reservoir heating system 60 in combination with the convection heating system 40 to regulate air temperature in the convection operation 114. In particular, the controller 122 can adjust or maintain air temperature by energizing one or both the first and second heating elements 62, 64, de-energizing one or both the first and second heating elements 62, 64, or maintaining one or both the first and second heating elements 62, 64 in an energized or de-energized state.

The invention has been described with reference to example embodiments described above. Modifications and alterations will occur to others upon a reading and understanding of this specification. Example embodiments incorporating one or more aspects described above are intended to include all such modifications and alterations insofar as they come within the scope of the appended claims.

What is claimed is:

1. A cooking appliance comprising:

a cooking chamber that defines an oven cavity;

a reservoir for holding water that is accessible from within the oven cavity;

a convection heating system comprising an electric-resistance convection heating element and a fan for guiding air across the convection heating element;

a reservoir heating system configured to heat the reservoir, the reservoir heating system comprising a gas burner located below the oven cavity; and a control system comprising a controller, the control system being configured to control the convection heating system and the reservoir heating system to perform a steam cooking operation in response to a user steam-cooking input, wherein during the steam cooking operation the control system is configured to regulate a temperature of air within the oven cavity by controlling both the convection heating system and the reservoir heating system.

2. The cooking appliance of claim 1, wherein the steam cooking operation includes a pre-heating step in which the control system is configured to adjust the temperature of air within the oven cavity from a first temperature to a second temperature by controlling the reservoir heating system.

3. The cooking appliance of claim 2, wherein during the pre-heating step, the control system is configured to adjust the temperature of air within the oven cavity from the first temperature to the second temperature by controlling both the reservoir heating system and the convection heating system.

4. The cooking appliance of claim 2, wherein the steam cooking operation includes a temperature regulating step after the pre-heating step, wherein during the temperature regulating step the control system is configured to regulate the temperature of air within the oven cavity by controlling both the convection heating system and the reservoir heating system.

5. The cooking appliance of claim 4, wherein during the temperature regulating step the control system is configured to adjust the temperature of air within the oven cavity from the second temperature to a third temperature by controlling both the reservoir heating system and the convection heating system.

6. The cooking appliance of claim 4, wherein during the temperature regulating step the control system is configured to maintain the temperature of air within the oven cavity at the second temperature by controlling both the reservoir heating system and the convection heating system.

7. The cooking appliance of claim 1, wherein the control system is configured to control the reservoir heating system to perform a baking operation in response to a user baking input, wherein during the baking operation, the control system is configured to regulate the temperature of air within the oven cavity by controlling the reservoir heating system independently of the convection heating system such that the control system does not control the convection heating system to regulate the temperature of air.

8. The cooking appliance of claim 1, the control system being configured to control the convection heating system to perform a convection operation in response to a user convection-cooking input, wherein during the convection operation the control system does not energize the reservoir heating system and is configured to regulate the temperature of the air within the oven cavity by controlling the convection heating system without controlling the reservoir heating system.

9. The cooking appliance of claim 1, further comprising a shroud that at least partially covers the reservoir, the shroud comprising a panel that defines an opening and a door for providing selective access to the reservoir through the opening, the door being pivotally coupled to the panel such that the door is pivotable between an open position and a closed position.

10. The cooking appliance of claim 1, said reservoir being disposed at and at least partially formed by a base of said cooking chamber.

11. A method of operating a cooking appliance having an oven cavity, a reservoir accessible from within the oven cavity, a convection heating system, and a reservoir heating system, the convection heating system including an electric-resistance convection heating element and a fan for guiding air across the convection heating element, the reservoir heating system including a gas burner located below the oven cavity, the method comprising a step of performing a steam cooking operation that includes controlling the convection heating system and the reservoir heating system to regulate a temperature of air within the oven cavity of the cooking appliance during the steam cooking operation.

12. The method of claim 11, wherein the steam cooking operation includes a pre-heating step during which the temperature of air within the oven cavity is adjusted from a first temperature to a second temperature using the reservoir heating system.

13. The method of claim 12, wherein during the pre-heating step, the temperature of air within the oven cavity is adjusted from the first temperature to the second temperature using both the reservoir heating system and the convection heating system.

14. The method of claim 12, further comprising a temperature regulating step after the pre-heating step, wherein during the temperature regulating step the temperature of air within the oven cavity is regulated using both the convection heating system and the reservoir heating system.

15. The method of claim 14, wherein during the temperature regulating step the temperature of air within the oven cavity is adjusted from the second temperature to a third temperature using both the reservoir heating system and the convection heating system.

16. The method of claim 14, wherein during the temperature regulating step the temperature of air within the oven cavity is maintained at the second temperature using both the reservoir heating system and the convection heating system.

17. The method of claim 11, further comprising the step of performing a baking operation, the baking operation comprising the step of regulating the temperature of air within the oven cavity by operating the reservoir heating system independently of the convection heating system such that the convection heating system is not operated to regulate the temperature of the air.

18. The method of claim 11, further comprising the step of performing a convection operation, the convection operation comprising the step of regulating the temperature of air within the oven cavity by operating the convection heating system without operating the reservoir heating system, wherein the reservoir heating system is not energized during the convection operation.

19. The method of claim 11, wherein the cooking appliance further comprises a shroud that at least partially covers the reservoir, the shroud comprising a panel that defines an opening and a door for providing selective access to the reservoir through the opening, the door being pivotally coupled to the panel such that the door is pivotable between an open position and a closed position.

20. The method of claim 11, wherein said reservoir is disposed at and at least partially formed by a base of said cooking chamber.

21. The cooking appliance according to claim 1, wherein during the steam cooking operation the control system is configured to regulate a temperature of air within the oven cavity by controlling both the electric-resistance convection heating element of the convection heating system and the gas burner of the reservoir heating system.

22. The method of claim 11, wherein the step of performing the steam cooking operation includes controlling the electric-resistance convection heating element of the convection heating system and the gas burner of the reservoir heating system to regulate the temperature of air within the oven cavity of the cooking appliance during the steam cooking operation.

* * * * *